US005734790A

United States Patent [19]

Taguchi

[11] Patent Number: 5,734,790

[45] Date of Patent: Mar. 31, 1998

[54] LOW BIT RATE SPEECH SIGNAL TRANSMITTING SYSTEM USING AN ANALYZER AND SYNTHESIZER WITH CALCULATION REDUCTION

[75] Inventor: Tetsu Taguchi, Tokyo, Japan

[73] Assignee: NEC Corporation, Tokyo, Japan

[21] Appl. No.: 686,475

[22] Filed: Jul. 25, 1996

Related U.S. Application Data

[63] Continuation of Ser. No. 271,505, Jul. 7, 1994, abandoned.

[30] Foreign Application Priority Data

Jul. 7, 1993 [JP] Japan ..... 5-192740

[51] Int. Cl.[6] ..... G10L 3/02

[52] U.S. Cl. ..... 395/2.25; 395/2.28

[58] Field of Search ..... 395/2.13, 2.25–27, 395/2.28, 2.29

[56] References Cited

U.S. PATENT DOCUMENTS

| | | | |
|---|---|---|---|
| 4,720,865 | 1/1988 | Taguchi | 381/49 |
| 4,908,863 | 3/1990 | Taguchi et al. | 381/36 |
| 4,937,868 | 6/1990 | Taguchi | 381/38 |
| 4,975,955 | 12/1990 | Taguchi | 381/36 |
| 4,991,215 | 2/1991 | Taguchi | 381/38 |
| 5,001,759 | 3/1991 | Fukui | 381/38 |
| 5,228,086 | 7/1993 | Morii | 381/36 |
| 5,305,421 | 4/1994 | Li | 395/2.28 |

FOREIGN PATENT DOCUMENTS

| | | |
|---|---|---|
| 2200819 | 11/1988 | United Kingdom . |
| 2204766 | 11/1988 | United Kingdom . |

OTHER PUBLICATIONS

Parsons, Thomas, *Voice and Speech Processing*, McGraw–Hill Book Co, 1986, pp. 180–182.

*Primary Examiner*—Allen R. MacDonald
*Assistant Examiner*—Robert C. Mattson
*Attorney, Agent, or Firm*—Sughrue, Mion, Zinn, Macpeak & Seas, PLLC

[57] ABSTRACT

In a speech signal encoding system comprising a maximum similarity series extracting unit (50) for producing a series of excitation pulses appearing at an equidistant time interval and an identical amplitude, the maximum similarity series extracting unit sums up, as a waveform, a series of autocorrelation coefficients to produce a series of summation result coefficients. The autocorrelation coefficients correspond to polarized pulses which are equal to one another in pulse interval and pulse amplitude. The polarized pulses form a plurality of pulse sequences which have phases different from one another. The maximum similarity series extracting unit extracts a polarity of each of the polarized pulses by the use of a dynamic programming method using a degree of an accumulated similarity as an evaluation measure and selects, as the excitation pulse series, one of the pulse sequences which has a maximum waveform similarity between the summation result coefficient series and a series of cross correlation coefficients.

12 Claims, 7 Drawing Sheets

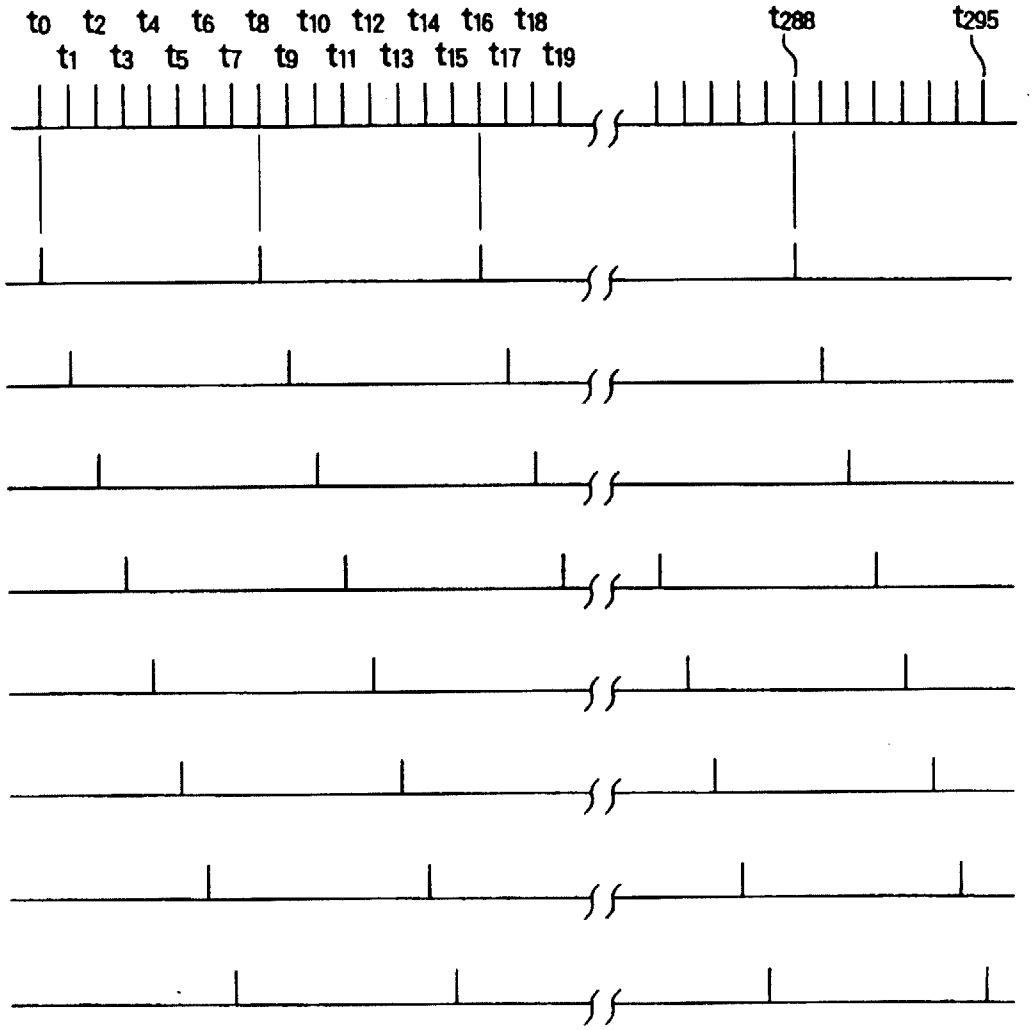
FIG. 4(A) TIME SLOTS IN ANALYSIS FRAME (Ai)
FIG. 4(B) PULSE PHASE "0"
FIG. 4(C) PULSE PHASE "1"
FIG. 4(D) PULSE PHASE "2"
FIG. 4(E) PULSE PHASE "3"
FIG. 4(F) PULSE PHASE "4"
FIG. 4(G) PULSE PHASE "5"
FIG. 4(H) PULSE PHASE "6"
FIG. 4(I) PULSE PHASE "7"

LOW BIT RATE SPEECH SIGNAL TRANSMITTING SYSTEM USING AN ANALYZER AND SYNTHESIZER WITH CALCULATION REDUCTION

This is a Continuation of application Ser. No. 08/271,505, filed on Jul. 7, 1994 now abandoned.

BACKGROUND OF THE INVENTION

This invention relates to a speech encoding system for use in encoding and decoding a speech signal by the use of a regular pulse excitation technique and, in particular, to an analyzer and a synthesizer for analyzing and synthesizing the speech signal.

A conventional speech encoding system of the type described is disclosed in an article contributed by Ed. F. Depretter and Peter Kroon to ICASSP, 1985 and proposed under the title of "Regular Excitation Reduction for Effective and Efficient LP-Coding of Speech" (pages 965 to 968). The proposed system is referred to as a regular pulse excitation system and is effective to encode a waveform of the speech signal, differing from a multipulse excitation system based on a spectrum analysis of a speech signal, as proposed by Atal et al. The regular pulse excitation system comprises an analysis side (namely, an analyzer) and a synthesis side (namely, a synthesizer) for analyzing and synthesizing the speech signal, respectively. More specifically, an input speech signal is subjected to linear predictive coding (LPC) to obtain a sequence of linear predictive coding (LPC) coefficients and to represent an envelope of the input speech signal. In addition, the speech signal of an exciting source is specified in the analyzer by a sequence of impulses which are arranged at an equal time instant and which are variable in phases and amplitudes. At any rate, the impulse sequence is delivered from the analyzer to the synthesizer as a part of analyzed data signals.

With this system, it is possible to faithfully reproduce the speech signal in the synthesizer as compared with the multipulse excitation system because the waveform of the speech signal itself is reproduced in the synthesizer. As a result, a reproduced speech signal naturally sounds without any unevenness. This means that a speech quality is improved in the regular pulse excitation system in comparison with the multipulse excitation system. In other words, the regular pulse excitation system has a speech quality which is not varied in dependence on sounds of persons and which is invariable.

However, the conventional regular pulse excitation system should encode a set of the analyzed data signals at a rate which is equal to or higher than 9.6 kb/s. Accordingly, it is difficult to transmit such analyzed data signals at a low bit rate lower than 9.6 kb/s.

On the other hand, a recent requirement is to transmit the analyzed data signals at a very low bit rate, such as 2.4 kb/s, to effectively utilize a transmission path.

In view of the recent requirement, a considerable improvement is introduced to such system by a speech signal encoding system disclosed in prior U.S. patent application Ser. No. 07/985,138 filed Dec. 3, 1992 by Tetsu Taguchi, the present applicant, based on Japanese Patent Application No. 319,427 of 1991. The improvement is directed mainly to enable the waveform of the speech signal be encoded at the very low bit rate.

However, it is necessary in the speech signal encoding system to carry out a large volume of calculation in order to analyze the speech signal.

SUMMARY OF THE INVENTION

It is an object of this invention to provide a speech encoding system which is capable of faithfully reproducing a speech signal at a very low bit rate such as 2.4 kb/s without carrying out a large volume of calculation.

It is another object of this invention to provide an analyzer which is used in the speech encoding system mentioned above and is capable of reducing the number of times of the calculation when the speech signal is analyzed in the analyzer.

It is still another object of this invention to provide a synthesizer which is communicable with the above-mentioned analyzer.

A speech signal analyzer to which this invention is applicable is for use in analyzing an input speech signal to produce a sequence of transmission data signals which appears as a result of an analysis of the input speech signal in the speech signal analyzer. According to an aspect of this invention, the speech signal analyzer comprises (a) preliminary processing means supplied with the input speech signal for preliminarily processing the input speech signal to produce a sequence of processed digital signals which is extracted from the input speech signal and which is arranged within an analysis frame having a predetermined frame time interval, (b) parameter calculating means for calculating a sequence of preselected parameters at the analysis frame as regards the input speech signal to produce a parameter signal representative of the preselected parameter sequence, (c) impulse response calculating means supplied with the parameter signal for calculating impulse responses with reference to the parameter signal, (d) cross correlating coefficient calculating means supplied with the impulse responses and the processed digital signal sequence for calculating series of cross correlation coefficients between the impulse responses and the processed digital signal sequence within the analysis frame to produce cross correlation coefficient signals representative of the cross correlation coefficients, (e) autocorrelation coefficient calculating means for calculating series of autocorrelation coefficients of the impulse responses, and (f) maximum similarity series extracting means coupled to the cross correlation coefficient calculating means and the autocorrelation coefficient calculating means for extracting a series of excitation pulses which appears at an equidistant time interval and an identical amplitude and which is defined by a phase and polarities such that the autocorrelation coefficient series exhibits a maximum similarity to the cross correlation coefficient series.

The maximum similarity series extracting means produces the series of the excitation pulses and a phase signal representative of the phase. The analyzer further comprises transmitting means responsive to the series of the excitation pulses, the phase signal, and the parameter signal for transmitting the transmission data signal sequence in relation to the series of the excitation pulses and the phase signal together with the parameter signal. In the speech signal analyzer, the maximum similarity series extracting means comprises autocorrelation series calculating means for successively summing up, as a waveform, the autocorrelation coefficients of each series to successively produce a summation result signal representative of a result of summation of the autocorrelation coefficients of each series, similarity measuring means responsive to the summation result signal and the cross correlation coefficient signals for measuring, by the use of a dynamic programming method using a degree of an accumulated similarity as an evaluation measure, a degree of similarities between the autocorrelation coefficients of each series and the cross correlation coefficients to determine each polarity of the excitation pulses by selecting the maximum similarity and to successively produce a sequence of polarity signals at every one of provisional excitation pulse sequences which are different in phase from one another, and phase determining means responsive to the polarity signal sequences for determining the series of the excitation pulses from the provisional excitation pulse series.

According to another aspect of this invention, a speech signal synthesizer is communication with the speech signal analyzer mentioned above and comprises a demultiplexer supplied with the transmission data signal sequence for demultiplexing the transmission data signals which is produced by synthesizing the phase signal with the polarity signal, sound source generating means connected to the demultiplexer and responsive to the phase signal and the polarity signal for generating a series of sound source pulses, interpolating means connected to the demultiplexer for interpolating the preselected parameters at every one of interpolation periods to produce a sequence of interpolated parameters obtained by interpolating the preselected parameters, and means for processing the sound source pulse series into an output speech signal with reference to interpolated parameter sequence.

A speech signal encoding system to which this invention is applicable comprises an analyzing side for analyzing a speech signal into a set of analyzed data signals and a synthesizing side for synthesizing the speech signal from the set of the analyzer data signals. The speech signal is given in the form of a sequence of digital speech signals divisible into a plurality of frames. In the speech signal encoding system, the analyzing side comprises:

(a) LPC analyzing means supplied with the digital speech signals for carrying out linear prediction of the digital speech signals at every one of the frames to produce a sequence of linear prediction coding coefficients, (b) impulse response calculating means for calculating impulse responses of an all-pole filter defined by the linear prediction coding coefficients, (c) cross correlation calculation means for calculating cross correlations between the impulse responses and the digital speech signals in each of the frames to produce a set of cross correlation coefficients, (d) autocorrelation calculation means for calculating autocorrelations of the impulse responses to produce a set of autocorrelation coefficients, (e) pulse polarity searching means supplied with a plurality of pulse series which are composed of polar pulses having an identical pulse period and an amplitude, the pulse polarity searching means being for calculating autocorrelation coefficient waveform summation series obtained by adding, as a waveform, each of the plurality of the pulse series to the autocorrelation coefficient series corresponding to the polar pulses and being for searching, by the use of a dynamic programming method using a degree of an accumulated similarity as an evaluation measure, for each polarity of the polar pulses that has a most resembled coefficient series to the cross correlation coefficient series, and (f) pulse series phase searching means for searching for a most likelihood pulse series giving a maximum waveform similarity between the autocorrelation coefficient waveform summation series and the cross correlation coefficient series.

The most likelihood pulse series is selected from the plurality of the pulse series each of which has the polar pulse obtained by the above-mentioned searching operation of the pulse polarity searching means and is different in phase from one another. The analyzing side further comprises transmitting means for producing a synthesized signal by synthesizing pulse information obtained by searching operation of the pulse series phase searching means and the linear prediction coding coefficients to transmit the synthesized signal as the set of the analyzed data signals. The synthesizing side comprises exciting source generating means for generating a sequence of exciting source pulses in response to the pulse series information, and synthesizing means for synthesizing a reproduction of the speech signal by the use of the linear prediction coding coefficients.

A pulse producing circuit to which this invention is applicable is for use in a speech signal analyzer and for producing a series of excitation pulses in response to an input speech signal. The excitation pulse series appears at an equidistant time interval and an identical amplitude. According to yet another aspect of this invention, the pulse producing circuit comprises summation means for successively summing up, as a waveform, a series of autocorrelation coefficients to produce a series of summation result coefficients. The autocorrelation coefficients correspond to polarized pulses which are equal to one another in pulse interval and pulse amplitude and form a plurality of pulse sequences having phases different from one another. The pulse producing circuit further comprises extracting means for extracting a polarity of each of the polarized pulses by the use of a dynamic programming method using a degree of an accumulated similarity as an evaluation measure, and selecting means for selecting, as the excitation pulse series, one of the pulse sequences which has a maximum waveform similarity between the summation result coefficient series and a series of cross collation coefficients relating to the input speech signal.

A pulse producing method to which this invention is applicable is for use in a speech signal analyzer and of producing a series of excitation pulses in response to an input speech signal. The excitation pulse series appears at an equidistant time interval and an identical amplitude. According to a further aspect of this invention, the pulse producing method comprises a step of successively summing up, as a waveform, a series of autocorrelation coefficients to produce a series of summation result coefficients. The autocorrelation coefficients correspond to polarized pulses which are equal to one another in pulse interval and pulse amplitude and form a plurality of pulse sequences having phases different from one another. The pulse producing method further comprises steps of extracting a polarity of each of the polarized pulses by the use of a dynamic programming method using a degree of an accumulated similarity as an evaluation measure, and selecting, as the excitation pulse series, one of the pulse sequences which has a maximum waveform similarity between the summation result coefficient series and a series of cross correlation coefficients relating to the input speech signal.

BRIEF DESCRIPTION OF THE DRAWING

FIG. 4 is a time chart for describing pulse sequences of zeroth through seventh phases used in the speech signal analyzer illustrated in FIG. 1;

DESCRIPTION OF THE EMBODIMENTS

Figure 1:
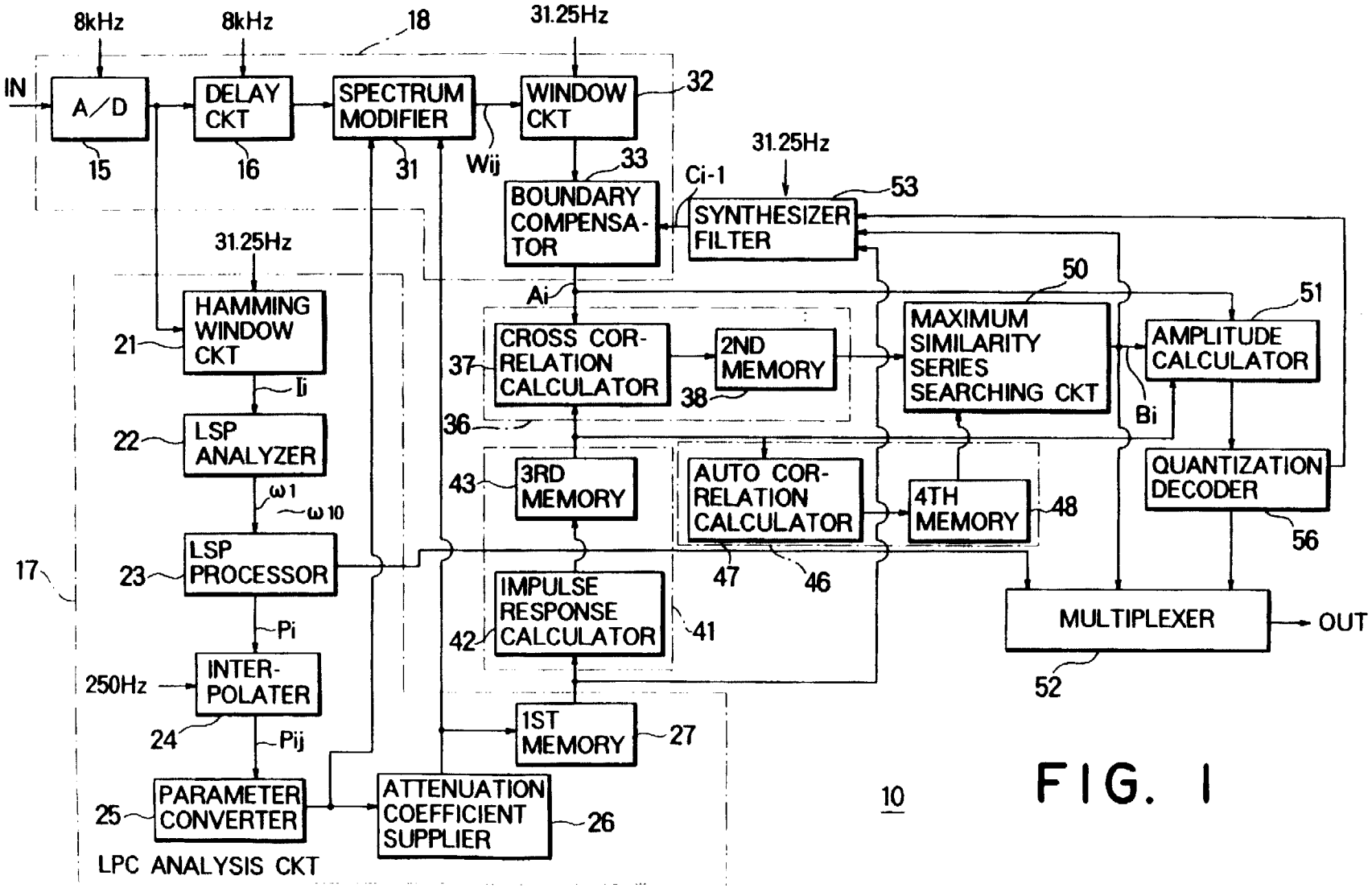
FIG. 1 is a block diagram of a speech signal analyzer according to a preferred embodiment of this invention.
Figure 2:
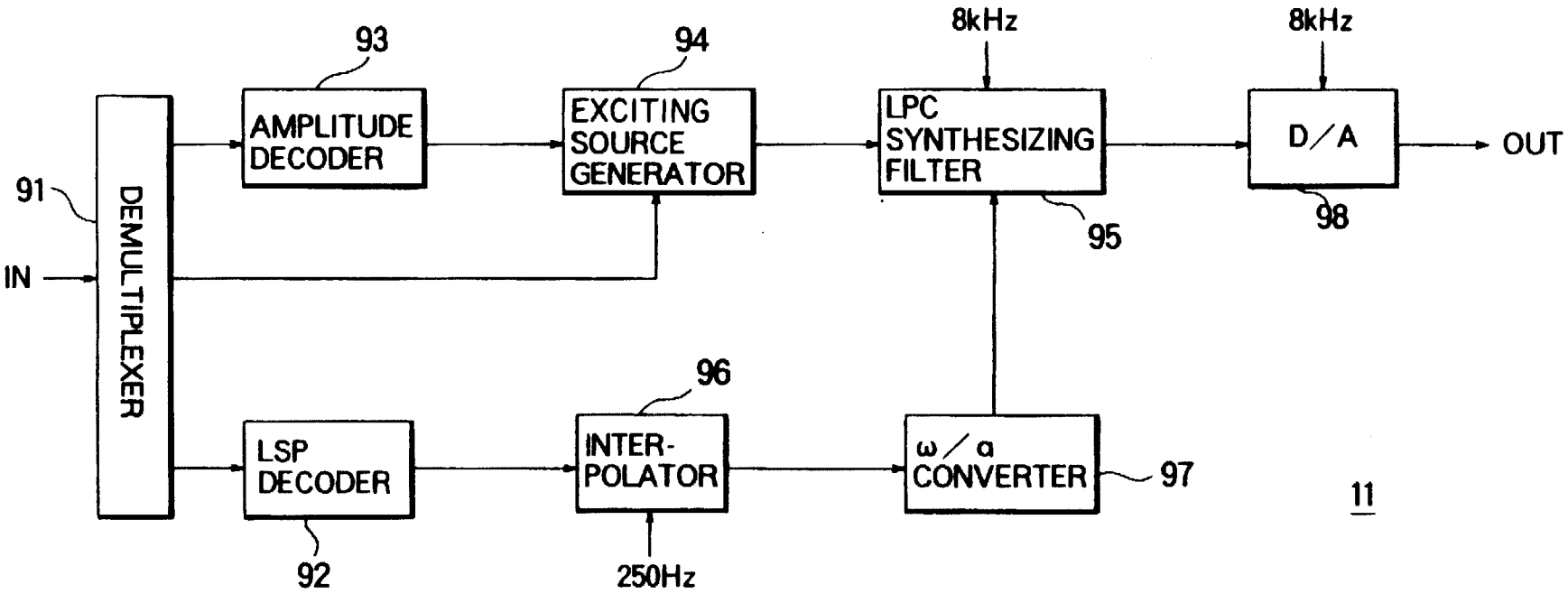
FIG. 2 is a block diagram of a speech signal synthesizer communicable with the speech signal analyzer illustrated in FIG. 1.

Referring to FIGS. 1 and 2, a speech encoding system comprises an analyzer 10 and a synthesizer 11 illustrated in FIGS. 1 and 2, respectively. In FIG. 1, the analyzer 10 is supplied with an input speech signal IN. The input speech signal IN is given to an analog-to-digital (A/D) converter 15 in the form of an analog signal which is subjected to band restriction and which is limited within a frequency range not higher than 3.4 kHz. The A/D converter 15 samples the input speech signal IN by a sampling pulse sequence to produce a sequence of sampled signals each of which is successively quantized into an input digital signal of a predetermined number of bits. The sampling pulse sequence is generated by a sampling pulse generator (not shown) in a well-known manner and is assumed to have a sampling frequency of 8 kHz, namely, a sampling period of 0.125 millisecond. In addition, the predetermined number may be equal, for example, to 12 bits.

At any rate, the input speech signal is sampled at every sampling period of 0.125 millisecond by the A/D converter 15 to be delivered as the input digital signal sequence to both a delay circuit 16 and a linear predictive coding (LPC) analysis circuit 17 both of which are operable in a manner to be described later in detail. Briefly, the LPC analysis circuit 17 serves to calculate LPC parameters.

On the other hand, it is to be noted that the A/D converter 15 and the delay circuit 16 form a part of a preliminary processing circuit 18 for preliminarily processing the input speech signal in a manner to be described later in detail.

In FIG. 1, the illustrated LPC analysis circuit 17 comprises a Hamming window circuit 21 for extracting a series of digital signals Ii from the digital signal sequence with reference to a Hamming window, namely, a temporal window having a time interval. The time interval may be assumed to be equal to 32 milliseconds in the illustrated example and may be called an analysis frame. In this connection, the illustrated analysis frame has a time interval of 32 milliseconds and may be discretely separated from the digital signal sequence with time. The analysis frame will be called an i-th analysis frame. To this end, the Hamming window circuit 21 is supplied with a frequency signal of 31.25 Hz from a frequency generator (not shown) to open the Hamming window of 32 milliseconds. Such a Hamming window circuit 21 can be implemented by known circuit elements in a known manner and will not therefore be described any longer. The digital signal series Ii within the analysis frame will be referred to as an analysis digital signal series.

In the LPC analysis circuit 17, the analysis digital signal sequence Ii is sent to a line spectrum pair (LSP) analyzer 22 which calculates a set of LSP parameters which may be recognized as one of the LPC parameters and which may be composed of first through tenth order parameters $\omega_1$ to $\omega_{10}$. Such LSP parameters can be obtained by carrying out an LPC analysis of the analysis digital signal series by the use of an autocorrelation method to at first produce $\alpha$ parameters and by further converting the $\alpha$ parameters into the LSP parameters.

The first through the tenth order parameters $\omega_1$ to $\omega_{10}$ are supplied to a LSP processor 23 to be quantized and decoded therein. Specifically, the LSP processor 23 processes the first through the tenth order parameters $\omega_1$ to $\omega_{10}$ to quantize each of the first through the fifth order parameters $\omega_1$ to $\omega_5$ into four bits and to further quantize each of the remaining parameters $\omega_6$ to $\omega_{10}$ into three bits. As a result, a whole of the first through the tenth order parameters $\omega_1$ to $\omega_{10}$ is represented by thirty-five (35) bits and is produced as a quantized LSP parameter of 35 bits. Furthermore, the LSP processor 23 locally decodes the quantized LSP parameter into a local decoded LSP parameter Pi which is accompanied by a quantization error. The local decoded LSP parameter Pi is delivered to an interpolator 24 which is operable in response to an interpolation timing signal having a frequency of 250 Hz sent from another frequency generator (not shown). From this fact, it is to be noted that the interpolator 24 interpolates the local decoded LSP parameter Pi at every time instant of four milliseconds to produce interpolated LSP parameters, although the local decoded LSP parameter Pi is produced only one time at every analysis frame.

Inasmuch as the analysis frame lasts for the time interval of 32 milliseconds, the local decoded LSP parameter Pi may be interpolated in the interpolator 24 eight times within every interpolation period of four milliseconds and is produced as a set of interpolated LSP parameters. If an i-th frame is selected as the analysis frame, the interpolated LSP parameters may be depicted at Pij where j takes an integer selected from −3, −2, −1, 0, 1, 2, 3, and 4, as will become clear. Herein, it may be considered that the interpolated LSP parameter Pi0 corresponds to a central one of the analysis digital signals Ii in the analysis frame.

Figure 3:
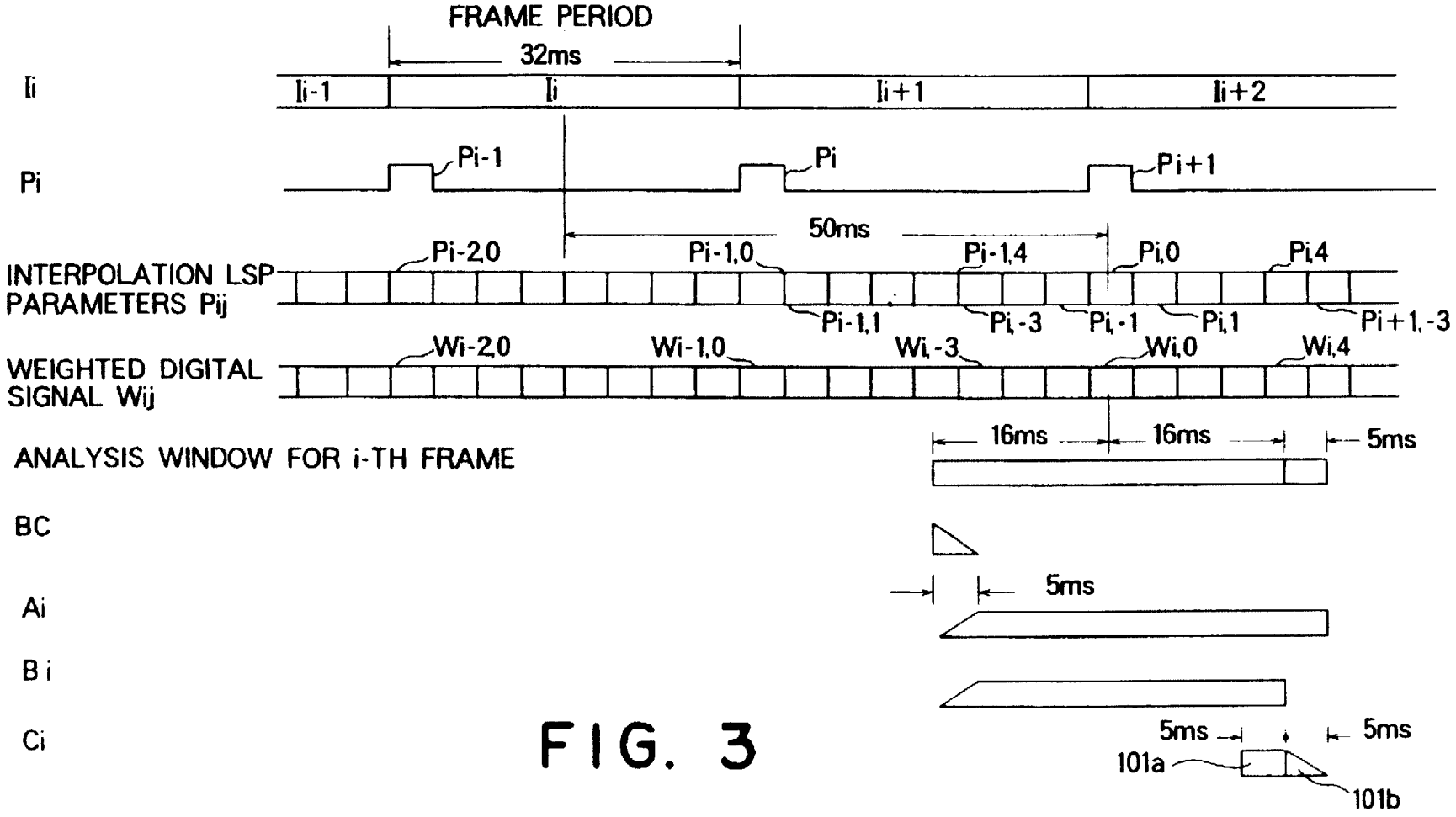
FIG. 3 is a time chart for use in describing operation of the speech signal analyzer illustrated in FIG. 1.

Temporarily referring to FIG. 3, the local decoded LSP parameter Pi for the i-th analysis frame is produced after lapse of the i-th analysis frame, as illustrated in FIG. 3. More specifically, the interpolated LSP parameter Pi0 appears simultaneously with the following local decoded LSP parameter Pi+1 calculated for the next frame period (i+1). This shows that each of the interpolated LSP parameters Pij for the i-th analysis frame is delayed by 50 milliseconds relative to each of the analysis digital signals Ii for the i-th analysis frame, as represented by a relationship between the local decoded LSP parameter Pi and the central analysis digital signal both of which are illustrated in FIG. 3.

Referring back to FIG. 1, each of the interpolated LSP parameters Pij is composed of first through tenth order parameters and is sent to a parameter converter 25 to be converted into first through tenth order ones of $\alpha$ converted parameters that are depicted at $\alpha_k$ where k is an integer between 1 and 10. The converted $\alpha$ parameters $\alpha_k$ are given to an attenuation coefficient supplier 26 which serves to multiply the converted $\alpha$ parameters $\alpha_k$ by attenuation coefficients depicted at $\gamma^k$ and to produce those products of the attenuation coefficients and the converted $\alpha$ parameters $\alpha_k$ which are represented by $\alpha_k\gamma^k$, where $\gamma$ is greater than zero and smaller than unity. The products will be called attenuated parameters and are memorized into a first memory 27.

On the other hand, the attenuated parameters are sent together with the converted α parameters $\alpha_k$, to a spectrum modifier 31 which is included in the preliminary processing circuit 18.

As shown in FIG. 3, it is to be noted that the interpolated LSP parameters Pij are delayed by the time interval of 50 milliseconds relative to the analysis digital signal series Ii. In this connection, the analysis digital signal series Ii is delayed by 50 milliseconds by the delay circuit 16 and is sent as a delayed digital signal sequence to the spectrum modifier 31. As a result, the spectrum modifier 31 is supplied with the delayed digital signal sequence which is delayed by 50 milliseconds relative to the analysis digital signal series Ii.

The spectrum modifier 31 weights perceptual weights in a known manner in accordance with a filter 15 characteristic which is defined by:

$$W(z) = \left(1 - \sum_{k=1}^{10} \alpha_k z^{-k}\right) / \left(1 - \sum_{k=1}^{10} \alpha_k \gamma^k z^{-k}\right). \quad (1)$$

The spectrum modifier 31 successively modifies the delayed digital signal sequence in accordance with Equation (1) to produce a sequence of weighted digital signals Wij in one-to-one correspondence to the interpolated LSP parameters Pij.

As a result, the weighted digital signals Wij are produced in synchronism with the interpolated LSP parameters Pij, as illustrated in FIG. 3.

In FIG. 1, the weighted digital signals Wij are sent to a window circuit 32 which defines an analysis window of 37 milliseconds in spite of the fact that a frequency signal of 31.25 Hz is given from a frequency generator (not shown). The analysis window of 37 milliseconds serves to separate the weighted digital signals Wij for the i-th analysis frame. In this event, the weighted digital signals Wij separated by the window circuit 32 are represented by a series of the weighted digital signals Wi-3, Wi-2, Wi-1, Wi0, Wi1, Wi2, Wi3, and Wi4 each of which has a time interval of 4 milliseconds. Among others, a central one Wi0 of the above-mentioned weighted digital signals may be called a central weighted digital signal, and appears at a central time instant of the weighted digital signals Wij.

As illustrated in FIG. 3, the analysis window for the i-th analysis frame has a previous part of 16 milliseconds prior to the central time instant, a following part of 16 milliseconds after the central time instant, and an additional part of 5 milliseconds succeeding the following part. This shows that the analysis window is longer than a time interval of the weighted digital signals Wij for the i-th analysis frame by five milliseconds.

In FIG. 1, the weighted digital signals Wij separated by the window circuit 32 are sent to a boundary compensator 33. The boundary compensator 33 is operable to compensate the weighted digital signals Wij at a boundary region of five milliseconds which is located in a preceding zone of the previous part of the i-th analysis frame. Such compensation is carried out in a manner to be described later in detail by the use of a boundary compensation signal BC which lasts for five milliseconds, as shown in FIG. 3, and which is produced in a manner to be described later. Anyway, the boundary compensator 33 produces a preliminary processed signal Ai as a result of preliminary processing of the i-th analysis frame. The preliminary processed signal Ai may be called a window processed signal because it is subjected to window processing in the window circuit 32 and the boundary compensator 33. Thus, the preliminary processed signal Ai is composed of a sequence of processed pulses having a constant amplitude and a constant phase and specifies an isolated analysis waveform. The preliminary processed signal may be called a sequence of processed digital signals and is supplied from the preliminary processing circuit 18 to a cross correlation circuit 36, which comprises a cross correlation calculator 37 and a second memory 38. Each of the processed pulses appears at a pulse period equal to the input digital signals sent from the A/D converter 15 and therefore has the pulse period of 0.125 milliseconds.

Herein, it is to be noted that the preliminary processed signal Ai has a time interval longer than the i-th frame period by five milliseconds, as mentioned before, and therefore has a trailing edge placed five milliseconds after completion of the i-th analysis frame. This shows that the above-mentioned pulse analysis if made with reference not only to the weighted digital signals Wij but also to a part of weighted digital signals in the following frame and enables environmental compensation of a portion close to the trailing edge of the weighted digital signal series Wij.

In addition, inasmuch as the preliminary processed signal Ai lasts for 37 milliseconds while the processed pulses in the preliminary processed signal Ai appears at the pulse period of 0.125 millisecond, the time interval of the preliminary processed signal Ai is composed of the processed pulses which are equal in number to 296 and which are arranged in zeroth through 295-th time slots $t_0$ to $t_{295}$, respectively.

Referring back to FIG. 1, the illustrated cross correlation calculator 37 is connected to an impulse response circuit 41 which comprises an impulse response calculator 42 and a third memory 43. Specifically, the impulse response calculator 42 is connected to the first memory 27 which is loaded with the attenuated parameters, namely, the attenuated α parameters from the attenuation coefficient supplier 26. The impulse response calculator 42 defines an all-pole filter which is given by:

$$H(z) = 1 / \left(1 - \sum_{k=1}^{10} \alpha_k \gamma^k z^{-1}\right). \quad (2)$$

In the example being illustrated, impulse responses are calculated on the basis of Equation (2) in relation to all of the zeroth through 295-th time slots and may be represented by $U_v^0$, $U_v^1$, . . . , $U_v^{295}$, respectively, where v is variable between 0 and 39. This shows that each of the impulse responses has a response time interval which is equal to forty samples, namely, 5 milliseconds because each sample appears at every period of 0.125 millisecond. In other words, each impulse response is calculated only within a duration of five milliseconds. This is because each of the impulse responses is sufficiently converged into zero after lapse of five milliseconds or so.

Since each attenuated α parameter $\alpha_k \gamma^k$ is renewed at every time interval of four milliseconds even during calculation of each impulse response, as mentioned before, the all-pole filter defined by Equation (2) may be called a time variant filter. Although the term "impulse response" may be generally defined only about a time invariant filter, the meaning of the term "impulse response" is expanded to a time variant filter in the instant specification, as mentioned before. At any rate, the impulse responses calculated in the above-mentioned manner are memorized in the third memory 43.

From the above, it is readily understood that the cross correlation calculator 37 is given the preliminary processed signal Ai and each of the impulse responses $U_v^0$, $U_v^1$, . . . , $U_v^{295}$ memorized in the third memory 43. Under the circumstances, the cross correlation calculator 36 calculates a sequence of cross correlation coefficients $\phi(q)$ between the preliminary processed signal Ai and the impulse responses $U_v^0, U_v^1, \ldots, U_v^{295}$ in accordance with the following equation (3):

$$\phi(q) = \sum_{v=0}^{39} A_{q+v} U_v^q, \tag{3}$$

where q is variable between 0 and 295, both inclusive.

On the other hand, the impulse responses $U_v^0, U_v^1, \ldots, U_v^{295}$ are also sent to an autocorrelation circuit 46 which comprises an autocorrelation calculator 47 and a fourth memory 38.

Supplied with the impulse responses $U_v^0, U_v^1, \ldots, {}_v^{295}$, the autocorrelation calculator 47 calculates a sequence of autocorrelation coefficients $\rho_r^q$ which are given by:

$$\rho_r^q = \sum_{v=-39}^{39} U_v^q U_{v+r}^q. \tag{4}$$

From Equation (4), it is readily understood that the autocorrelation coefficients $\rho_r^q$ calculated are equal in number to 296 and each of the autocorrelation coefficients $\rho_r^q$ is calculated with reference to 79 samples and is memorized in the fourth memory 48. In any event, the autocorrelation coefficients $\rho_r^q$ are calculated within the analysis frame, namely, the i-th analysis frame.

The autocorrelation coefficients $\rho_r^q$ and the cross correlation coefficients $\phi(q)$ are read out of the second and the fourth memories 38 and 48 to be sent to a maximum similarity series searching circuit 50.

Briefly, the maximum similarity series searching circuit 50 searches for a sequence of excitation pulses Bi for the i-th analysis frame (namely, the time interval of 32 milliseconds) from the leading edge of the preliminary processed signal Ai by the use of the autocorrelation coefficients $\rho_r^q$ and the cross correlation coefficients $\phi(q)$. The excitation pulses Bi are representative of an exciting source and may be referred to as exciting source information. In this event, such a searching operation is based on conditions that the excitation pulses Bi are composed of an equidistant time interval and an identical amplitude and are variable in phase and in polarity of each pulse.

Referring to FIG. 4 together with FIG. 1, the maximum similarity series searching circuit 50 will be described more in detail. The maximum similarity series searching circuit 50 is operated in the i-th analysis frame in accordance with zeroth through seventh pulse sequences which have zeroth through seventh pulse phases "0" to "7", respectively, as illustrated in FIG. 4. In this connection, it is readily understood that the zeroth pulse sequence of the zeroth phase "0" appears at the zeroth, the eighth, . . . , and the 288-th time slots t0, t8, . . . , t288 and the first pulse sequence of the first phase "1" appears at the first, the ninth, . . . , the 289-th time slots t1, t9, . . . , t289. Likewise, the seventh pulse sequence appears at the seventh, the fifteenth, . . . , and the 295-th time slots t7, t15, . . . , t295 within the i-th analysis frame. Thus, each of the zeroth through the seventh pulse sequences is produced at a time slot period of eight time slots, as illustrated in FIG. 4.

Figures 5A, 5B, 5C, 5D:
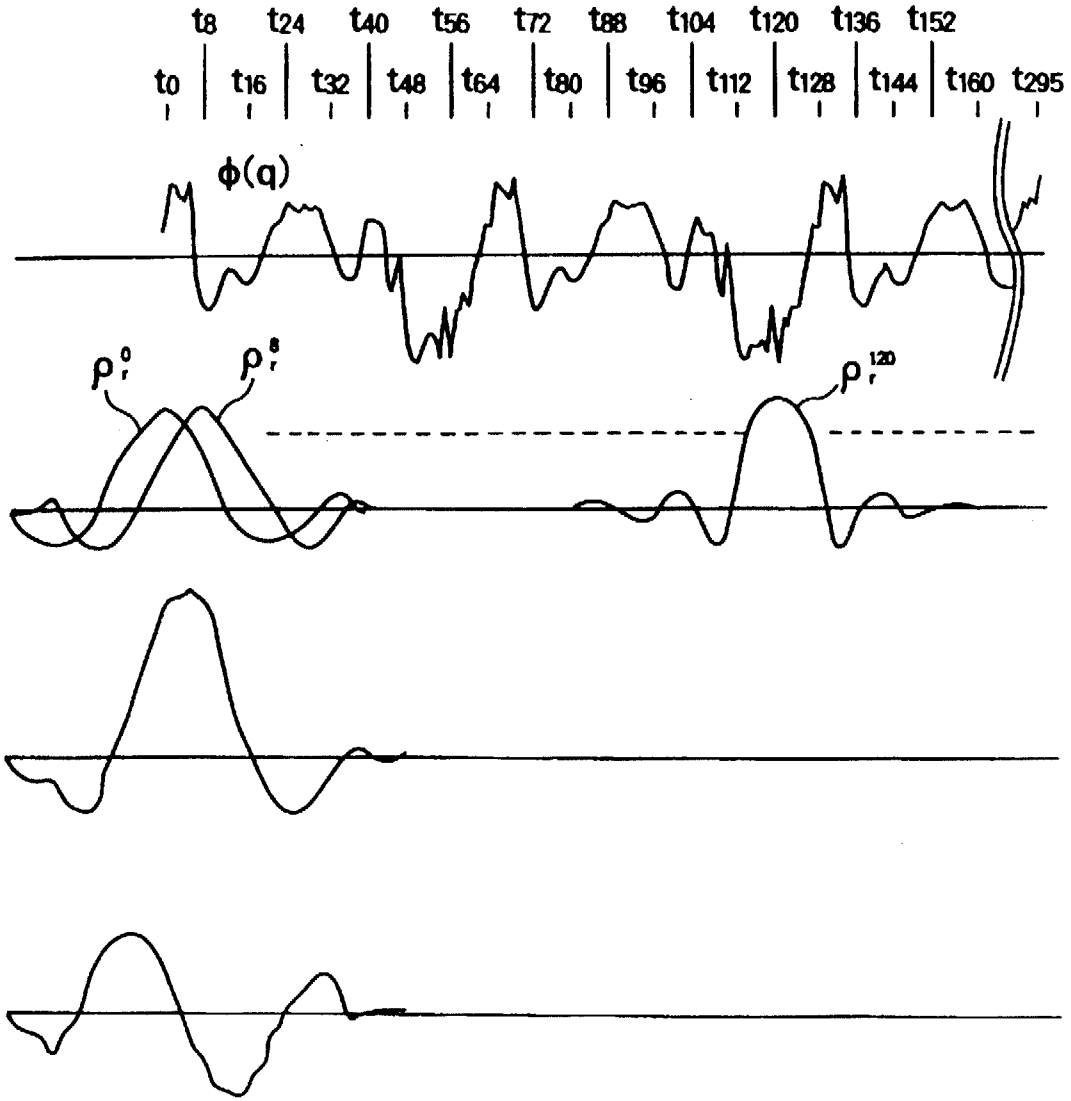
FIG. 5 shows waveforms for use in describing operation of a part of the speech signal analyzer illustrated in FIG. 1.

Referring to FIG. 5 in addition to FIG. 1, the maximum similarity series searching circuit 50 is supplied with the cross correlation coefficients $\phi(q)$ and the autocorrelation coefficient $\rho_r^q$ from the second and the fourth memories 38 and 48, as illustrated in FIGS. 5(A) and (B), respectively. In FIG. 5(A), the cross correlation coefficients $\phi(q)$ are shown over the zeroth through the 295-th time slots in the illustrated frame. On the other hand, only three series of the autocorrelation coefficients $\rho_r^0$, $\rho_r^8$, and $\rho_r^{120}$ are illustrated in FIG. 5(B). It is to be noted that each of the autocorrelation coefficient series $\rho_r^0$, $\rho_r^8$, and $\rho_r^{120}$ is produced at the zeroth, the eighth, and the 120-th time slots as a result of varying the term r between −39 and 39, both inclusive.

As understood from Equation (4), the autocorrelation coefficients $\rho^q$ are calculated in a range arranged between the sample of −39 and the sample of 39 with each sample sampled at the sample period of 0.125 millisecond.

In the illustrated example, the maximum similarity series searching circuit 50 sums up the autocorrelation coefficients $\rho_r^q$ at every time slot (q) to detect similarities, as will become clear later in detail. Herein, the autocorrelation coefficients $\rho_r^q$ between the zeroth and the seventh time slots tO and t7 may be considered in relation to $\rho_r^0, \rho_r^1, \ldots, \rho_r^{45}$ where r is variable between −39 and 39.

When attention is directed to the zeroth phase "0", consideration may be made within the time duration between t0 and t7 as regards $\rho_r^0$, $\rho_r^8$, $\rho_r^{16}$, $\rho_r^{24}$, $\rho_r^{32}$, and $\rho_r^{40}$ with r being variable between −39 and 39.

The zeroth pulse sequence of the zeroth phase "0" is composed of thirty-two pulses arranged in the zeroth, the eighth, . . . , the 248-th time slots. Under the circumstances, the maximum similarity series searching circuit 50 determines each polarity of the thirty-two pulses having the zeroth phase "0". At first, consideration is made about all combinations of polarities arranged in the zeroth, the eighth, the sixteenth, the twenty-fourth, the thirty-second, and the fortieth time slots t0, t8, t16, t24, t32, and t40. Such combinations are equal in number of 64 in total. To this end, the autocorrelation coefficients in the above-mentioned time slots are added to one another in consideration of the polarity of each autocorrelation coefficient to obtain sixty-four series of the autocorrelation coefficients and to consequently specify a waveform in consideration of a polarity of each pulse. In FIG. 5, curve 5C represents $\rho_r^0 + \rho_r^8$, and curve 5D represents $\rho_r^0 - \rho_r^8$.

Thereafter, the maximum similarity series searching circuit 50 measures the similarities between a waveform specified by the cross correlation coefficients and each waveform specified by the sixty-four series of the autocorrelation coefficients and selects a maximum one of the similarities, namely, a maximum degree of the similarities. Such measurement of the above-mentioned similarities can be carried out by calculating initial cross correlations between the cross correlation coefficients $\phi(q)$ and each series of the autocorrelation coefficients $\rho$ in the above-mentioned time slots for a time interval defined by the zeroth through the seventh time slots t0 to t7. Herein, it is assumed that the initial cross correlations among the zeroth through the seventh time slots are depicted at $\psi(7)$ and a maximum one of the initial cross correlations is selected by the maximum similarity series searching circuit 50. In this event, the maximum one of the initial cross correlations is considered as representing the maximum similarity between the above-mentioned waveforms. The procedure mentioned before can be specified by:

$$\psi(7) = \max \begin{cases} \sum_{q=0}^{7} \phi(q)[+\rho_q^0 + \rho_{q-8}^8 + \rho_{q-16}^{16} + \rho_{q-24}^{24} + \rho_{q-32}^{32} + \rho_{q-40}^{40}] \\ \sum_{q=0}^{7} \phi(q)[+\rho_q^0 + \rho_{q-8}^8 + \rho_{q-16}^{16} + \rho_{q-24}^{24} + \rho_{q-32}^{32} - \rho_{q-40}^{40}] \\ \sum_{q=0}^{7} \phi(q)[+\rho_q^0 + \rho_{q-8}^8 + \rho_{q-16}^{16} + \rho_{q-24}^{24} + \rho_{q-32}^{32} + \rho_{q-40}^{40}] \\ \cdot \\ \cdot \\ \cdot \\ \sum_{q=0}^{7} \phi(q)[-\rho_q^0 - \rho_{q-8}^8 - \rho_{q-16}^{16} - \rho_{q-24}^{24} - \rho_{q-32}^{32} - \rho_{q-40}^{40}] \end{cases} \quad (5)$$

By the use of Equation (5), selection is made in the maximum similarity series searching circuit 50 about one of the sixty-four autocorrelation coefficient series that is included in the maximum one of the initial cross correlations. Subsequently, decision is made about a polarity of a zeroth pulse arranged in the zeroth time slot t0 on the basis of a result of summation of the one of the sixty-four autocorrelation coefficient series. The decided polarity will be represented by sgn(0).

Next, further consideration is directed to combinations of polarities of pulses arranged in the following six time slots, namely, the eighth, the sixteenth, the twenty-fourth, the thirty-second, the fortieth, and the forty-eighth time slots t8, t16, t24, t32, t40, and t48 in addition to the zeroth pulse arranged in the zeroth time slot t0. Such combinations of the polarities are equal in number to sixty-four.

For this purpose, the sixty-four autocorrelation coefficient series are formed to specify waveforms in consideration of a polarity of each pulse and are represented by series of additions like in Equation (5). In this event, each autocorrelation coefficient series is represented by an addition of the above-mentioned six time slots and a product of the autocorrelation coefficient $\rho_q^0$ and the zeroth pulse having a determined polarity (sgn(0)). Subsequently, similarities of waveforms are measured between the cross correlation coefficients $\phi$(15) and the respective sixty-four autocorrelation coefficient series to detect a maximum one of the similarities. Like in Equation (5), cross correlations $\psi$ are calculated between the cross correlation coefficients and the respective sixty-four autocorrelation coefficient series A maximum one of the cross correlations $\psi$(15) is selected in accordance with Equation (6) given by:

$$\psi(15) = \max \begin{cases} \sum_{q=0}^{15} \phi(q)\,[\mathrm{sgn}(0)\rho_q^0 + \\ \rho_{q-8}^8 + \rho_{q-16}^{16} + \rho_{q-24}^{24} + \rho_{q-32}^{32} + \rho_{q-40}^{40} + \rho_{q-48}^{48}] \\ \sum_{q=0}^{15} \phi(q)\,[\mathrm{sgn}(0)\rho_q^0 + \\ \rho_{q-8}^8 + \rho_{q-16}^{16} + \rho_{q-24}^{24} + \rho_{q-32}^{32} + \rho_{q-40}^{40} + \rho_{q-48}^{48}] \\ \cdot \\ \cdot \\ \cdot \\ \sum_{q=0}^{15} \phi(q)\,[\mathrm{sgn}(0)\rho_q^0 - \\ \rho_{q-8}^8 - \rho_{q-16}^{16} - \rho_{q-24}^{24} - \rho_{q-32}^{32} - \rho_{q-40}^{40} - \rho_{q-48}^{48}] \end{cases} \quad (6)$$

Thereafter, one of the sixty-four autocorrelation coefficient series is extracted from the maximum one of the cross correlations $\psi$(15) to determine only a polarity of a pulse which is located in the eighth time slot t8 and which is depicted at sgn(8).

Thus, the polarities of the pulses in the zeroth and the eighth time slots are determined and fixed by the maximum similarity series searching circuit 50. Furthermore, a polarity (sgn(16)) of a pulse arranged in the sixteenth time slot t16 is determined with the polarities of pulses fixed in the zeroth and the eighth time slots t0 and t8 and with polarities of pulses voluntarily determined in a plus sign or minus sign in connection with the pulses located in the sixteenth, the twenty-fourth, the thirty-second, the fortieth, the forty-eighth, and the fifty-sixth time slots t16, t24, t32, t40, t48, and t56.

Similar procedure is continued until a polarity (sgn(248)) of a pulse in the 248-th time slot t248 is determined by the maximum similarity series searching circuit 50 in the manner which will later be described in detail. At any rate, the polarities of the pulses in the zeroth phase are given by the above-mentioned procedure from the zeroth time slot t0 to the 248-th time slot t248. In other words, the polarities of the thirty-two pulses are determined in conjunction with the pulse sequence of the zeroth phase in the above-mentioned manner.

The above procedure is applied to each pulse sequence which has the first through the seventh phases. As a result, a decision is made about the polarities of the pulses which are arranged in the respective time slots assigned to the first through the seventh phases "1" to "7".

Subsequently, autocorrelation coefficients are further calculated as regards the pulse sequences that have the zeroth through the seventh phases and the polarities decided and that may be referred to as zeroth through seventh pulse sequences each of which is composed of thirty-two pulses, as mentioned before. The autocorrelation coefficient series for each of the zeroth through the seventh pulse sequences are compared to the cross correlation coefficient series to measure similarities between waveforms specified by the autocorrelation coefficient series and the cross correlation series. As a result of measurement, selection is made as regards one of the zeroth through the seventh pulse sequences that has a maximum similarity and that is specified by a selected one of the zeroth through the seventh phases "0" to "7". Such a selected pulse sequence is produced as the excitation pulse sequence Bi from the maximum similarity series searching circuit 50 together with a pulse phase signal representative of the selected phase, as illustrated in FIG. 3.

From this fact, it is to be noted that each pulse of the selected pulse sequence appears only once at each of the eight time slots. In other words, the selected pulse sequence produced within the 256 time slots are equal in number to thirty-two. On the other hand, the selected phase can be represented by three bits so as to specify the zeroth through the seventh phases, and thus the pulse phase signal may have three bits.

In any event, the selected pulse sequence, namely, the excitation pulse sequence Bi, is sent together with the pulse phase signal to an amplitude calculator 51, a multiplexer 52, and an LPC synthesizer filter 53, as illustrated in FIG. 1.

Referring back to FIG. 1, the excitation pulses Bi of 32 bits and the pulse phase signal of 3 bits are delivered to the multiplexer 52, the amplitude calculator 51, and the LPC synthesis filter 53.

In this event, the amplitude calculator 51 obtains a synthesized waveform from the excitation pulse sequence Bi sent from the maximum similarity series searching circuit 50. In the illustrated example, the amplitude calculator 51 cannot carry out any filter calculation, but calculates the synthesized waveform by adding impulse responses memorized in the third memory 43. Subsequently, the amplitude calculator 51 determines a pulse amplitude by comparing the synthesized waveform with the pulse analysis waveform Ai. Specifically, the pulse amplitude is determined by selecting a pulse amplitude which gives a maximum similarity between the synthesized waveform and the pulse analysis waveform Ai in electric power of a whole frame. Such decision of the pulse amplitude can be made by calculating a minimum amplitude A which minimizes P given by Equation (7):

$$P = \sum_{l=0}^{255} (w_l - Ax_l)^2, \tag{7}$$

where $w_{80}$ represents a sample value in a time slot t1 of the pulse analysis waveform Ai and $x_{80}$ represents a sample value in a time slot t1 of the synthesized waveform on the assumption that energy becomes equal to 1.

From Equation (7), it is understood that the pulse amplitude A is given by:

$$A = \left(\sum_{l=0}^{255} w_l\right) / \left(\sum_{l=0}^{255} x_l\right). \tag{8}$$

The pulse amplitude A calculated by the amplitude calculator 51 is sent to a quantization decoder 56 to be quantized into a quantized amplitude signal of six bits which is delivered to the multiplexer 52 on one hand and to the LPC synthesizer filter 53 on the other hand.

Figure 6:
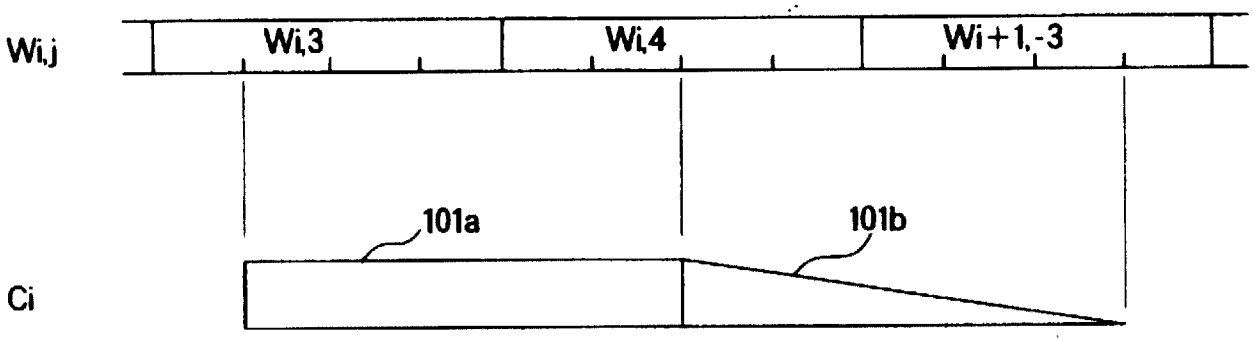
FIG. 6 shows a time chart which enlarges a portion of the time chart illustrated in FIG. 3.

The LPC synthesizer filter 53 is supplied from the first memory 27 with the α parameters multiplied by the attenuation coefficients (γ) for the i-th frame. In addition, the LPC synthesizer filter 53 is also supplied from the maximum similarity series searching circuit 50 with a pulse sequence which represents a pulse amplitude for a time duration of 5 milliseconds after the i-th frame of 32 milliseconds and which specifies the pulse amplitude calculated by the amplitude calculator 51. Under the circumstances, the LPC synthesizer filter 53 produces, as the control signal Ci, a filter output signal as illustrated in FIGS. 3 and 6. As illustrated in FIGS. 3 and 6, the control signal Ci has a leading half portion 101*a* of 5 milliseconds and a trailing half portion 101*b* of 5 milliseconds. The leading half portion 101*a* is operable as a pulse excitation portion while the trailing half portion 101*b* is operable as an oscillation attenuating portion. The pulse excitation portion reproduces a signal portion for a time interval which begins at a time instant of 27 milliseconds in the window of the i-th frame and which lasts at a time instant of 32 milliseconds. In other words, the pulse excitation portion corresponds to a reproduction signal of the weighted digital signal which is located for 5 milliseconds immediately before (i+1)-th frame specified by the window of 37 milliseconds.

It is to be noted that the leading portion of the window of 37 milliseconds in the i-th frame is influenced by a preceding portion which may be the oscillation attenuated portion of an (i−1)-th frame.

The boundary compensator 33 serves to compensate for the leading portion of the i-th frame by subtracting, from the weighted digital signals for the i-th frame, the oscillation attenuation portion 101*b* of five milliseconds for the (i−1)-th frame. In other words, the boundary compensation signal Ci−1(FIGS. 3 and 6) of 5 milliseconds calculated for (i-1)-th frame is subtracted from the window output signal of the 37 milliseconds. At any rate, the boundary compensation is carried out during the leading portion of the i-th frame to obtain the pulse analysis waveform Ai.

The multiplexer 52 is supplied with the quantized LSP parameters of 35 bits, the pulse phase signal of 3 bits, and the pulse polarity signal of 32 bits, (i.e., the excitation pulse sequence Bi) and the pulse amplitude signal of 6 bits at every frame period of 32 milliseconds. Herein, the quantized LSP parameters, the pulse phase signal, the pulse polarity signal, and the pulse amplitude signal are sent to the multiplexer 52 from the LSP quantization decoder 52, the maximum similarity series searching circuit 50, and the amplitude quantization decoder 56, as mentioned before.

A total bit number of the above-mentioned signals becomes equal to seventy-six (76) bits. In this example, a frame period bit is added to 76 bits at a rate of four bits per five frames, namely, at a rate of 0.8 bit per a single frame. As a result, a transmission frame has an average bit rate of 76.8 bits. At any rate, a transmission data signal is sent from the analyzer 10 to the synthesizer 11 at an output bit rate which is equal to 76.8 bits/0.032, namely, 2400 bits/second.

Referring to FIG. 2, the synthesizer 11 is communicable with the analyzer 10 illustrated with reference to FIG. 1 and is supplied as a reception data signal with the transmission data signal having the transmission bit rate of 2400 bits/second, as mentioned before. The reception data signal is received by a demultiplexer 91 and is demultiplexed like the transmission data signal at every frame into the quantized LSP parameters of thirty-five bits, the pulse phase signal of three bits, the pulse polarity signal of thirty-two bits, and the pulse amplitude signal of six bits all of which have been mentioned in conjunction with the analyzer 10 (FIG. 1) and which may be somewhat varied or modified during transmission due to noise or so. However, no distinction will be made between the transmission data signal and the reception data signal for brevity of description.

In the synthesizer 11, the quantized LSP parameters are delivered to an LSP decoder 92 while the pulse amplitude signal is delivered to an amplitude decoder 93. Moreover, both the pulse phase signal and the pulse polarity signal are sent to an exciting source generator 94. The amplitude decoder 93 decodes the pulse amplitude signal into a decoded amplitude which is supplied to the exciting source generator 94 supplied with the pulse phase signal and the pulse polarity signal from the demultiplexer 91. The exciting source generator 94 generates a sequence of reproduced pulses which has a pulse phase and a pulse polarity indicated by the pulse phase signal and the pulse polarity signal, respectively, and which has an amplitude identical with the decoded amplitude sent from the amplitude decoder 93. The reproduced pulse sequence is sent to an LPC synthesizing filter 95 which is operable in response to a timing pulse sequence of 8 kHz.

On the other hand, the LSP decoder 92 decodes the quantized LSP parameters into a sequence of decoded LSP parameters which is sent to an interpolator 96 at every period of thirty-two milliseconds. The interpolator 96 itself carries out interpolation at every period of four milliseconds, namely, at an interpolation frequency of 250 Hz. In this connection, the interpolator 96 interpolates the decoded LSP parameters at every interpolation frequency of 250 Hz to produce a sequence of interpolated LSP parameters at every period of four milliseconds.

The interpolated LSP parameters are supplied to an ω/α converter 97 to be converted into converted α parameters. The LPC synthesizing filter 95 has the converted α parameters and is excited by the reproduced pulse sequence to produce a sequence of quantized sample signals. The quantized sample signals are given to a digital-to-analog (D/A) converter 98 operable in response to a sequence of clock pulses having a clock frequency of 8 kHz. The D/A converter 98 converts the quantized sample signals into a converted analog signal which is sent as an output analog signal OUT to a low pass filter (not shown) to restrict the converted analog signal within a bandwidth of 3.4 kHz.

Figure 7:
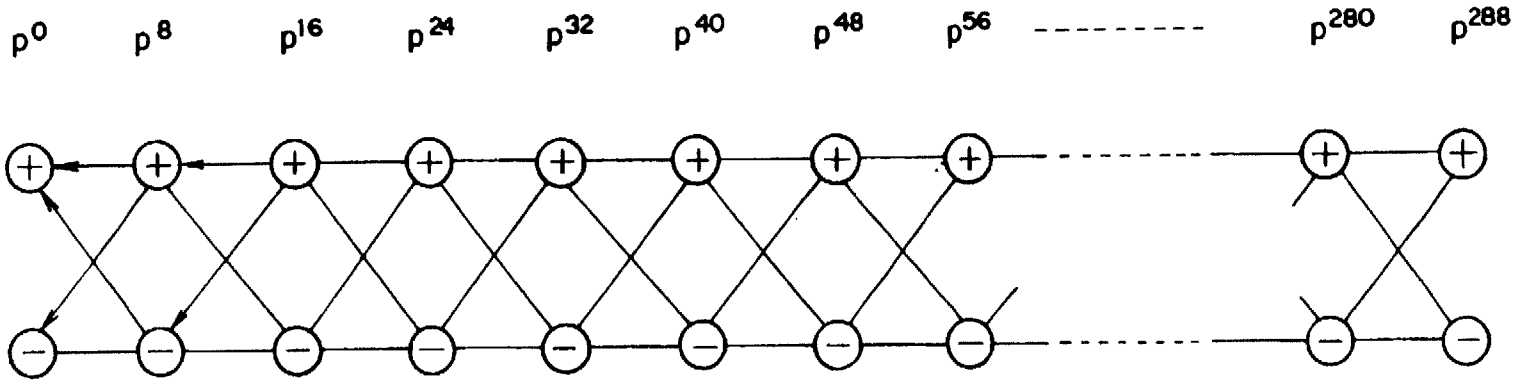
FIG. 7 is a diagram for describing a method which is of determining a polarity of the pulse by a maximum similarity series searching circuit included in the speech signal analyzer of FIG. 1.

Referring to FIG. 7 in addition, description will proceed to a method which is of determining a polarity of the pulse. In the manner which will presently be described, the maximum series searching unit 50 carries out a dynamic programming method known in the art.

In FIG. 7, it is assumed that the pulse located in the time slot $t_0$ has a polarity sgn(0) which is "positive". In this event, a similarity measure between the autocorrelation coefficients $\rho_q^0$ and the cross correlation coefficient series $\phi(q)$ of the impulse response in the time slot $t_0$ is represented by $d_0$ and is given by:

$$d_0 = \sum_{q=0}^{39} \phi(q)\rho_q^0 \tag{9}$$

If the pulse in the time slot $t_0$ has a polarity sgn(0) which is "negative", then the similarity measure is equal to $-d_0$.

Next, it is assumed that the pulse in the time slot $t_8$ has a polarity sgn(8) which is "positive". In this event, the similarity measure between the autocorrelation coefficients $\rho_q^8$ and the cross correlation coefficient series $\phi(q+8)$ of the impulse response in the time slot $t_8$ is represented by $d_8$ and is given by:

$$d_8 = \sum_{q=-8}^{39} \phi(q+8)\rho_q^8 \tag{10}$$

If the pulse in the time slot $t_8$ has a polarity sgn(8) which is "negative" , then the similarity measure is equal to $-d_8$.

It is assumed that the above-mentioned sgn(8) is "positive". So, sgn(0) is uniquely determined in accordance with the maximum search of the accumulated similarity measure (accumulated similarity) $D_8(+)$ as specified by the following Equation (11).

$$D_8(+) = \max \begin{cases} d_8 + d_0 \\ d_8 - d_0 \end{cases} \tag{11}$$

In the event that sgn(8) is "negative", then sgn(0) is uniquely determined in accordance with the maximum search of the accumulated similarity measure $D_8(-)$ as specified by the following Equation (12 ).

$$D_8(-) = \max \begin{cases} -d_8 + d_0 \\ d_8 - d_0 \end{cases} \tag{12}$$

If the pulse in the time slot $t_{16}$ has a polarity sgn(16) which is "positive", the similarity measure between the autocorrelation coefficients $\rho_q^{16}$ and the cross correlation coefficient series $\phi(q+16)$ of the impulse response in the time slot $t_{16}$ is presented by $d_{16}$ and is given by:

$$d_{16} = \sum_{q=-16}^{39} \phi(q+16)\rho_q^{16} \tag{13}$$

Thus when sgn(16) is "positive" and "negative", respectively, the accumulated similarities $D_{16}(+)$ and $D_{16}(-)$ are uniquely determined in accordance with the maximum search as specified by the following Equations (14) and (15).

$$D_{16}(+) = \max \begin{cases} d_{16} + D_8(+) \\ d_{16} + D_8(-) \end{cases} \tag{14}$$

$$D_{16}(-) = \max \begin{cases} -d_{16} + D_8(+) \\ d_{16} + D_8(-) \end{cases} \tag{15}$$

Likewise, the accumulated similarities $D_{24}(+)$, $D_{24}(-)$, $D_{32}(+)$, $D_{32}(-)$, . . . , $D_{280}(+)$, $D_{280}(-)$ are successively calculated. Finally, the similarity measure $d_{288}$ in the time slot $t_{288}$ is given by:

$$d_{288} = \sum_{q=-39}^{7} \phi(q+288)\rho_q^{288} \tag{16}$$

Accordingly, the accumulated similarities $D_{288}(+)$ and $D_{288}(-)$ are calculated by the following Equations (17) and (18).

$$D_{288}(+) = \max \begin{cases} d_{288} + D_{280}(+) \\ d_{288} + D_{280}(-) \end{cases} \tag{17}$$

$$D_{288}(-) = \max \begin{cases} -d_{288} + D_{280}(+) \\ d_{288} + D_{280}(-) \end{cases} \tag{18}$$

Finally, the polarity sgn(288) of the pulse in the time slot $t_{288}$ is determined by the search result given by the following Equation (19).

$$D_{max} = \max \begin{cases} D_{288}(+) \\ D_{288}(-) \end{cases} \tag{19}$$

When the maximum accumulated similarity $D_{max}$ is, for example, equal to the accumulated similarity $D_{288}(+)$, the polarity sgn(288) of the pulse in the time slot $t_{288}$ is determined to be "positive". Subsequently, based on this determination, the polarities sgn(280), sgn(272), . . . , sgn(16), sgn(8), and sgn(0) of the pulses are successively determined in accordance with the diagram illustrated in FIG. 7 and Equations (9) through (18). Namely, the maximum similarity series searching circuit 50 is for producing a series of excitation pulses in the manner which will be described in the following. The maximum similarity series searching circuit 50 sums up, as a waveform, a series of autocorrelation coefficients to produce a series of summation result coefficients. The autocorrelation coefficients correspond to polarized pulses which are equal to one another in pulse interval and pulse amplitude. The polarized pulses form a plurality of pulse sequences which have phases different from one another. The maximum similarity series searching circuit 50 extracts a polarity of each of the polarized pulses by the use of a dynamic programming method using a degree of an accumulated similarity as an evaluation measure and selects, as the excitation pulse series, one of the pulse sequences which has a maximum waveform similarity between the summation result coefficient series and a series of cross correlation coefficients.

As described above, the maximum series searching unit 50 determines the polarity of the pulse by the use of the dynamic programming method. It is therefore possible to determine the polarities for the pulse sequence having a desired phase by calculating the similarity measures only 37 times (=(288/8) +1). Therefore, the amount of calculation can be substantially reduced. This results in improvement of the processing speed and reduction in scale of the hardware.

In addition, the speech encoding system illustrated in FIGS. 1 and 2 represents exciting source information by the use of a sequence of pulses which is specified by a polarity and a pulse phase determined in response to the input speech signal and which appears in an equidistant time interval and an invariable pulse amplitude. With this structure, it is possible to encode a waveform at a low bit rate of, for example, 2.4 kb/s and to improve a speech quality in spite of such a low bit rate.

While this invention has thus far been described in conjunction with a preferred embodiment thereof, it will readily be possible for those skilled in the art to put this invention into practice in various other manners. For example, K parameters may be used as the LPC parameters instead of the LSP parameters.

What is claimed is:

1. A speech signal analyzer for producing a transmission data signal in response to an input speech signal, said speech signal analyzer comprising:

preliminary processing means supplied with said input speech signal for producing a sequence of processed digital signals sampled from said input speech signal and arranged within an analysis frame, said analysis frame having a predetermined frame time interval, there being defined pulse sequences of said analysis frame each comprising a respectively exclusive plurality of equidistantly timed pulses each corresponding to one of said processed digital signals, each of said processed digital signals corresponding to one of said pulses in one of said pulse sequences, and said pulse sequences defining corresponding phases of said analysis frame;

parameter calculating means for calculating a sequence of preselected parameters at said analysis frame as regards said input speech signal to produce a parameter signal representative of said preselected parameter sequence;

impulse response calculating means supplied with said parameter signal for calculating corresponding impulse responses;

cross correlating coefficient calculating memos supplied with said impulse responses and said processed digital signal sequence for calculating series of cross correlation coefficients between said impulse responses and said processed digital signal sequence within said analysis frame to produce a representative cross correlation coefficient signal;

autocorrelation coefficient calculating means for calculating autocorrelation coefficients based on said impulse responses, said autocorrelation coefficient calculating means producing a respective series of said autocorrelation coefficients for each of said phases; and maximum similarity series extracting means, coupled to said cross correlation coefficient calculating means and said autocorrelation coefficient calculating means, for producing a series of excitation pulses and a pulse phase signal which identifies a selected phase, each of said excitation pulses having an equidistant time interval and an identical amplitude, each of said excitation pulses having a respective polarity such that said respective series of autocorrelation coefficients exhibits, with respect to others of said respective series of autocorrelation coefficients, a maximum similarity to said representative cross correlation coefficient signal for said selected phase;

wherein said maximum similarity series extracting means comprises:

autocorrelation series calculating means for successively summing up, as a waveform, said respective series of said autocorrelation coefficients to successively produce a corresponding summation result signal for each said phase;

similarity measuring means responsive to said corresponding summation result signal and said representative cross correlation coefficient signal for (1) measuring a respective degree of similarity between each said respective series of autocorrelation coefficients and said representative cross correlation coefficient signal, (2) determining said respective polarity of each of said excitation pulses by selecting the maximum similarity, and (3) successively producing a sequence of polarity signals for each phase to provide corresponding provisional excitation pulse sequences; and phase determining means responsive to said polarity signal sequences for selecting said selected phase and for producing, as said series of excitation pulses, said provisional excitation pulse sequence corresponding to said select phase;

wherein said respective polarity of each of said excitation pulses is determined by dynamic programming;

wherein said dynamic programming determines said respective polarity based on an accumulated similarity evaluation measure.

2. A speech signal analyzer as claimed in claim 1, wherein:

said preselected parameters are specified by linear predictive coding parameters; and said parameter calculating means comprises:

interpolating means for interpolating said linear predictive coding parameters at every one of a plurality of interpolation periods, each of said plurality of interpolation periods being shorter than said analysis frame, said interpolating means producing a sequence of interpolated parameters obtained by interpolating said linear predictive coding parameters; and means for producing said interpolated parameters as said parameter signal.

3. A speech signal analyzer as claimed in claim 2, wherein said impulse response calculation means comprises:

calculation means coupled to said interpolating means for calculating the impulse response of an all-pole filter defined by said interpolated parameters; and means for supplying said impulse responses to said cross correlation coefficient calculating means.

4. A speech signal analyzer as claimed in claim 1, wherein said preliminary processing means comprises:

spectrum modifying means for modifying said input speech signal in its spectrum into a modified speech signal with reference to said predetermined parameters and attenuated parameters calculated on the basis of said predetermined parameters; and means for producing said modified speech signal as said digital signal sequence.

5. A speech signal analyzer as claimed in claim 1, wherein:

each of said impulse responses appears at a predetermined time interval ; and said dynamic programming is carried out during said predetermined time interval.

6. A speech signal synthesizer communicable with said speech signal analyzer claimed in claim 1, comprising:

a demultiplexer supplied with said transmission data signal sequence for demultiplexing said transmission data signals into said preselected parameters and a synthesized signal which is produced by synthesizing said phase signal with said polarity signal;

sound source generating means connected to said demultiplexer and responsive to said phase signal and said polarity signal for generating a series of sound source pulses;

interpolating means connected to said demultiplexer for interpolating said preselected parameters at every one of interpolation periods to produce a sequence of interpolated parameters obtained by interpolating the preselected parameters; and means for processing said sound source pulse series into an output speech signal with reference to said interpolated parameter sequence.

7. A speech signal encoding system comprising:

an analyzing side for analyzing a speech signal into a set of analyzed data signals, and a synthesizing side for synthesizing said speech signal from said set of said analyzed data signals;

said speech signal being a sequence of digital speech signals divisible into frames;

said analyzing side comprising:

LPC analyzing means for carrying out linear prediction of said digital speech signals at each of said frames to produce a sequence of linear prediction coding coefficients;

impulse response calculating means for calculating impulse responses of an all-pole filter defined by said sequence of linear prediction coding coefficients;

cross correlation calculation means for calculating cross correlations between said impulse responses and said digital speech signals in each of said frames to produce a set of cross correlation coefficients;

autocorrelation calculation means for calculating autocorrelations of said impulse responses to produce a set of autocorrelation coefficients for each of a plurality of series of said digital speech signals, each said series of said digital speech signals comprising nonadjacent, equidistantly spaced ones of said digital speech signals, each of said digital speech signals of one of said frames corresponding to one of said series of digital speech signals, said plurality of series of digital speech signals defining phases of said frame;

pulse polarity searching means supplied with said set of cross correlation coefficients and said set of autocorrelation coefficients for each of said phases of said frame, each of said phases comprising polar pulses, each of said polar pulses having an identical pulse period and an identical amplitude, said pulse polarity searching means (1) calculating autocorrelation coefficient waveform summation series obtained by adding, as a waveform, each of said plurality of pulse series to corresponding ones of said set of autocorrelation coefficients corresponding to said polar pulses, and (2) searching, by the use of dynamic programming using a degree of an accumulated similarity as an evaluation measure, for each polarity of said polar pulses that has said corresponding ones of said set of autocorrelation coefficients which define a waveform most closely resembling a waveform defined by said set of cross correlation coefficients;

pulse series phase searching means for searching for a most similar one of said plurality of pulse series which has a maximum waveform similarity between said autocorrelation coefficient waveform summation series and said set of cross correlation coefficients; and transmitting means for (1) producing a synthesized signal by synthesizing pulse information obtained by said searching operation of said pulse series phase searching means and said sequence of linear prediction coding coefficients, and (2) transmitting said synthesized signal as said set of said analyzed data signals; and said synthesizing side comprising:

exciting source generating means for generating a sequence of exciting source pulses in response to said pulse series information; and synthesizing means for synthesizing a reproduction of said speech signal by the use of said sequence of linear prediction coding coefficients.

8. A speech signal encoding system as claimed in claim 7, further comprising:

first LPC coefficient interpolating means for interpolating said sequence of linear prediction coding coefficients at every one of a plurality of predetermined periods to produce a first sequence of interpolated parameters; and second LPC coefficient interpolating means for interpolating, at each of said plurality of predetermined periods, said sequence of linear prediction coding coefficients transmitted from said analysis section;

said impulse response calculating means calculating said impulse responses on the basis of said sequence of linear prediction coding coefficients interpolated by said first LPC coefficient interpolating means;

said synthesizing means synthesizing said speech signal by the use of said sequence of linear prediction coding coefficients interpolated by said second LPC coefficient interpolating means.

9. A speech signal encoding system as claimed in claim 7, wherein:

each of said impulse responses is provided to said pulse series phase searching means at a predetermined time interval; and said dynamic programming method is carried out during said predetermined time interval.

10. A pulse producing circuit for use in a speech signal analyzer and for producing a series of excitation pulses in response to an input speech signal, each pulse of said series of excitation pulses appearing at an equidistant time interval and an identical amplitude, said pulse producing circuit comprising:

summation means for successively summing up, as a waveform, a series of autocorrelation coefficients to produce a series of summation result coefficients, each one of said series of autocorrelation coefficients corresponding to polarized pulses, each of said polarized pulses being equal to one another in pulse interval and pulse amplitude, and each of said polarized pulses belonging to one of a plurality of pulse sequences, each of said plurality of pulse sequences having a different respective phase;

extracting means for extracting a respective pulse polarity of each of said polarized pulses by the use of dynamic programming using a degree of an accumulated similarity as an evaluation measure; and selecting means for selecting, as said series of excitation pulses, one of said plurality of pulse sequences which provides a maximum waveform similarity between said series of summation result coefficients and a series of cross correlation coefficients relating to said input speech signal.

11. A pulse producing method for use in a speech signal analyzer and for producing a series of excitation pulses in response to an input speech signal, each pulse of said series of excitation pulses appearing at an equidistant time interval and an identical amplitude, said pulse producing method comprising the steps of:

successively summing up, as a waveform, a series of autocorrelation coefficients to produce a series of summation result coefficients, said autocorrelation coefficients corresponding to polarized pulses which are equal to one another in pulse interval and pulse amplitude, and form a plurality of pulse sequences having phases different from one another;

using dynamic programming to determine a respective polarity of each of said polarized pulses, wherein a degree of accumulated similarity is used as an evaluation measure; and selecting, as said series of excitation pulses, one of said plurality of pulse sequences which provides a maximum waveform similarity between said series of summation result coefficients and a series of cross correlation coefficients relating to said input speech signal.

12. A speech signal analyzer for producing a transmission data signal in response to a sampled speech signal, each sample of which is represented by a corresponding digital signal, a predetermined number of said digital signals forming a digital signal sequence corresponding to an analysis frame of predetermined duration and defining pulses of said analysis frame, said analysis frame having said pulses in said predetermined number, said analysis frame having a predetermined number of phases defined such that each phase corresponds to a series of equidistantly timed nonadjacent ones of said pulses, and said pulses each correspond to only one of said phases of said analysis frame, each of said pulses having a respective pulse polarity, said speech signal analyzer comprising:

preliminary processing means for producing said digital signal sequence from said speech signal;

parameter calculating means for producing a parameter signal representative of a sequence of preselected parameters which are calculated on the basis of said digital signals of said analysis frame;

impulse response calculating means for calculating impulse responses on the basis of said parameter signal;

cross correlating coefficient calculating means for producing a cross correlation coefficient signal representative of a series of cross correlation coefficients which are calculated on the basis of said impulse responses and said digital signals of said analysis frame;

autocorrelation coefficient calculating means for producing, for each said phase of said analysis frame, a respective series of autocorrelation coefficients of said impulse responses;

maximum similarity series extracting means for producing an excitation pulse series and a pulse phase signal, and comprising:

autocorrelation series calculating means for producing, for each said phase of said analysis frame, a corresponding summation result signal which is calculated by successively summing, as a waveform, said respective series of autocorrelation coefficients corresponding to said phase;

similarity measuring means for producing, for each said phase of said analysis frame, a corresponding provisional excitation pulse sequence based on said corresponding summation result signal of said phase and on said representative cross correlation coefficient signal, such that:

each pulse of said provisional excitation pulse sequence corresponds to one of said pulses of said phase, is equidistant in time with respect to adjacent pulses of said provisional excitation pulse sequence of said phase, and is identical in amplitude with all other pulses of said provisional excitation pulse sequence;

each pulse of said provisional excitation pulse sequence has said respective pulse polarity determined through dynamic programming by selecting the maximum degree of similarity, according to an accumulated similarity evaluation measure, between said respective series of autocorrelation coefficients corresponding to said phase and said representative cross correlation coefficient signal; and phase determining means for producing, as said excitation pulse series, a selected one of said provisional excitation pulse sequences, said selected provisional excitation pulse sequence having, in comparison to a remainder of said provisional excitation pulse sequences, a maximum similarity to said representative cross correlation coefficient signal, wherein said pulse phase signal identifies said one of said phases to which said selected provisional excitation pulse sequence corresponds.

* * * * *

UNITED STATES PATENT AND TRADEMARK OFFICE

CERTIFICATE OF CORRECTION

PATENT NO. : 5,734,790
DATED : March 31, 1998
INVENTOR(S) : Taguchi

It is certified that error appears in the above-identified patent and that said Letters Patent is hereby corrected as shown below:

Column 9, line 14, delete "$_v^{295}$" and insert --$U_v^{295}$--;

Column 13, line 13, delete "$w_{80}$" and insert --$w_{\Gamma}$--, delete "t1" and insert --$t_{\Gamma}$--;

Column 13, line 14, delete "$x_{80}$" and insert --$x_{\Gamma}$--;

Column 13, line 15, delete "t1" and insert --$t_{\Gamma}$--.

Signed and Sealed this

Twenty-second Day of December, 1998

*Attest:*

Bruce Lehman

BRUCE LEHMAN

*Attesting Officer*

*Commissioner of Patents and Trademarks*